United States Patent [19]

Yamagishi et al.

[11] Patent Number: 4,635,757

[45] Date of Patent: Jan. 13, 1987

[54] MAST ASSEMBLY FOR A FORKLIFT

[75] Inventors: Takashi Yamagishi; Masaru Ohsawa, both of Tokyo, Japan

[73] Assignee: Komatsu Forklift Kabushiki Kaisha, Tokyo, Japan

[21] Appl. No.: 624,092

[22] Filed: Jun. 25, 1984

[30] Foreign Application Priority Data

Jun. 27, 1983 [JP] Japan ..... 58-114316

[51] Int. Cl.[4] ..... B66B 9/20; B66F 9/08

[52] U.S. Cl. ..... 187/9 E; 187/95

[58] Field of Search ..... 187/9 E, 9 R, 95; 52/111, 118, 121; 182/63, 67; 414/628–631

[56] References Cited

U.S. PATENT DOCUMENTS

| | | | |
|---|---|---|---|
| 3,298,463 | 1/1967 | McIntosh | 187/9 E |
| 3,851,732 | 12/1974 | Wagner et al. | 187/9 E |
| 4,356,893 | 11/1982 | Johannson | 187/9 E |
| 4,476,960 | 10/1984 | Yarris | 187/9 E |
| 4,505,635 | 3/1985 | Shinoda | 187/9 E X |

FOREIGN PATENT DOCUMENTS

| | | | |
|---|---|---|---|
| 249582 | 1/1966 | Australia | 187/9 E |

*Primary Examiner*—Joseph J. Rolla
*Assistant Examiner*—Nils Pederson
*Attorney, Agent, or Firm*—Frost & Jacobs

[57] ABSTRACT

A forklift mast assembly for attachment to a self propelled vehicle includes a pair of outer masts horizontally spaced from each other, and a pair of inner masts disposed just inwardly of the outer masts for up and down rolling motion relative to the same. Each outer mast is of U shaped cross section, defining a space opening inwardly or toward the other outer member for rotatably receiving an inner roll on the bottom end of the associated inner mast. Each inner mast is of H shaped cross section, defining an outwardly open space for rotatably receiving an outer roll on the top end of the associated outer mast, and an inwardly open space for rotatably receiving one pair of carrier rolls on a prong carrier. The outer masts are further rimmed to bear the axial thrust of inner rolls when the prong carrier is loaded out of the perpendicular in the plane of the mast assembly. Preferably, the inner masts are also rimmed to bear against the outer rolls and, if desired, against the carrier rolls as well. The improved mast configurations make it possible to eliminate a tie at least from between the bottom ends of the inner masts. Ties may also be removed from between the top ends of the outer masts and from between the top ends of the inner masts, depending upon the arrangement of the other parts of the mast assembly.

3 Claims, 32 Drawing Figures

MAST ASSEMBLY FOR A FORKLIFT

BACKGROUND OF THE INVENTION

This invention relates to a mast assembly for attachment to a self propelled vehicle to constitute a forklift which is in widespread use for hoisting and moving heavy materials or objects. The invention is directed more specifically to a forklift mast assembly capable of sustaining nonperpendicular loading from its prongs to a greater extent than heretofore, with the consequent elimination of a tie or ties from between the masts and, accordingly, the enhancement of operator front vision.

Forklift mast assemblies in general have a pair of horizontally spaced apart outer masts and a pair of inner masts horizontally spaced apart to a less extent than the outer masts. The inner masts are arranged just inwardly of the outer masts for up and down motion along the same via a pair of outer rolls on the top ends of the outer masts and a pair of inner rolls on the bottom ends of the inner masts. For the up and down motion of the inner masts a pair of hydraulic cylinders are mounted upstandingly to the respective outer masts, with their piston rods arranged for extension and contraction with the inner masts. A pair of chains extend between the respective outer masts and a prong carrier means, having two or more lifting prongs affixed thereto, via respective sprockets that are movable up and down with the piston rods or with the inner masts. Thus the extension and contraction of the cylinders result in the up and down motion of the inner masts and of the prong carriers.

As heretofore constructed, however, the forklift mast assembly of the above general organization has had a problem arising from the cross sectional shapes of the outer and inner masts. Each outer mast has so far been of U shaped cross section, defining a space open toward the other outer mast to rotatably receive the inner roll on the bottom end of the associated inner mast. Each inner mast has also been of approximately U shaped cross section, defining a space open toward the other inner mast, but with a fin extending from its web toward the associated outer mast for rolling engagement with the outer roll on the top end of the outer mast. These cross sectional shapes of the outer and inner masts make it essential to interconnect both top and bottom ends of the outer masts, and of the inner masts, with ties to prevent them from spreading apart when loaded out of the perpendicular in its own plane from the prong carrier means. The mast ties have had to be of considerable thickness and width, with a sufficient strength to positively hold the masts in the correct relative working positions in the face of the nonperpendicular forces that may be exerted thereon from a considerable height from the bottom ends of the outer masts.

The presence of the bulky ties between the outer and inner masts seriously impairs the operator's front vision. An adequate perception of happenings to the front of the vehicle is essential for the proper operator control of the forklift. The mast ties are also objectionable as they render the mast assembly expensive, heavy, and difficult of assemblage.

SUMMARY OF THE INVENTION

The present invention has succeeded in reducing the number of ties between the masts of a forklift mast assembly to a minimum, with the resulting numerous advantages set forth subsequently.

Summarized briefly, the invention provides, in a forklift mast assembly having prong carrier means disposed on one side thereof, the combination comprising a pair of upstanding, horizontally spaced apart outer masts, each having an outer roll rotatably mounted thereto in the vicinity of its top end for rotation about a horizontal axis parallel to the plane of the mast assembly, and a pair of upstanding inner masts disposed just inwardly of the respective outer masts, with each inner mast having an inner roll rotatably mounted thereto in the vicinity of its bottom for rotation about a horizontal axis parallel to the plane of the mast assembly.

Each outer mast comprises a web oriented normal to the plane of the mast assembly, first and second flanges extending from the opposite sides of the web toward the other outer mast in right angular relationship with the web, and a rim bent right angularly from the first flange, which is disposed farther away from the prong carrier means than is the second flange, into parallel spaced relationship with the web. The web, rimmed first flange and second flange of each outer mast define in combination a space, opening toward the other outer mast, to rotatably receive the inner roll on the associated one of the inner masts.

Each inner mast, on the other hand, comprises a web oriented normal to the plane of the mast assembly, and a pair of flanges formed on opposite sides of the web at right angles therewith and extending at least in a direction away from the other inner mast. Thus the web and flanges of each inner mast define in combination a space, opening away from the other inner mast, to rotatably receive the outer roll on the associated one of the outer masts.

The rims of the first flanges of the outer masts function to bear the axial thrusts of the inner rolls when the inner masts are loaded out of the perpendicular in the plane of the mast assembly from the prong carrier means. Consequently the bottom tie of the inner masts, and preferably the top tie of the outer mast as well, can be eliminated without the possibility of the masts spreading apart under the nonperpendicular load that may be imposed on the prong carrier means operatively engaged with the inner masts for up and down motion along the same.

The absence of the inner mast bottom tie, or of both inner mast bottom tie and outer mast top tie, from the forklift mast assembly offers several advantages. First, it enhances the operator's front vision, enabling him to control the forklift with the full perception of what is happening in front of the machine. The mast assembly can be built, moreover, with a fewer number of parts and therefore at a reduced cost. The assemblage of the mast assembly is also easier as the bottom ends of the inner masts and the top ends of the outer masts need not be tied together. Furthermore the front-to-rear depth dimension of the mast assembly can be made less than hitherto, with the consequent shifting of the center of gravity of the forklift rearwardly away from the mast assembly. The stability of the machine can thus be improved in its front to rear direction. Additionally, as an empty space is created between the outer masts and between the inner masts, the mounting of piping for fluid actuated cylinders and of other ancillarity parts will be easier.

There are also disclosed herein additional embodiments wherein the outer and inner masts are so shaped cross sectionally, and so engaged with carrier rolls on the prong carrier means, that not only the inner mast bottom tie and outer mast top tie but also the inner mast top tie can be eliminated, leaving only the outer mast bottom tie. This arrangement makes the above noted advantages of the invention all the more pronounced.

The above and other features and advantags of this invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

Figure 1:
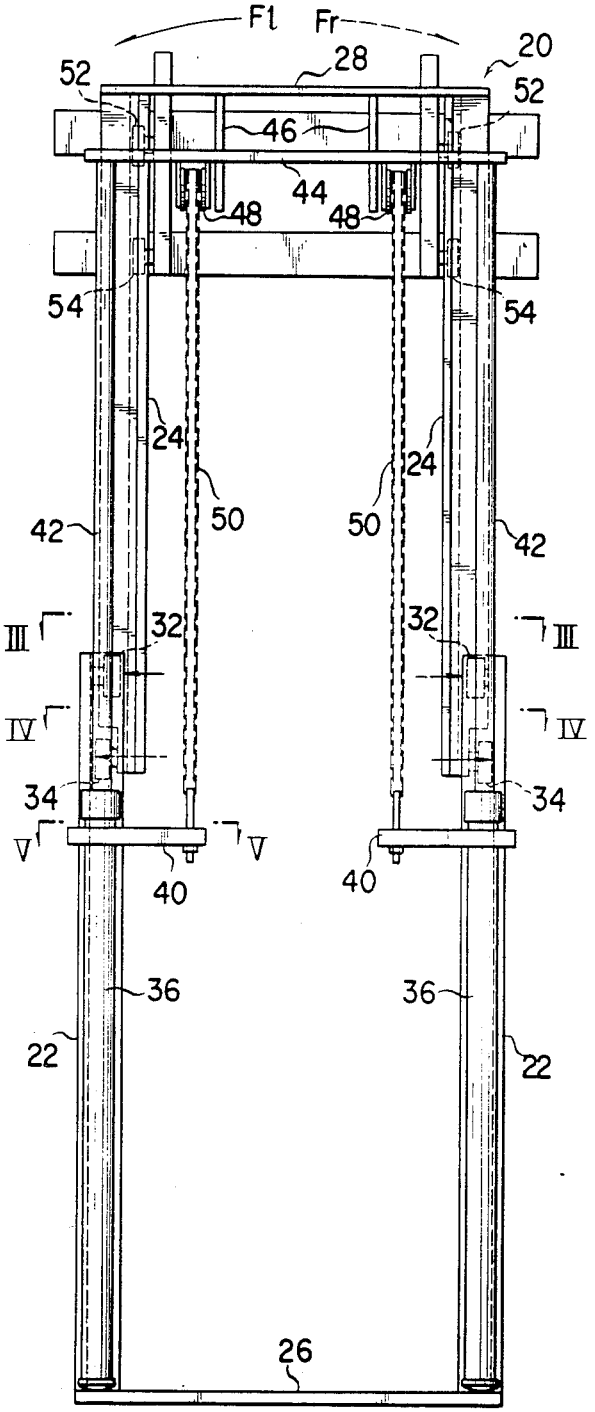
FIG. 1 is a rear elevation of the forklift mast assembly embodying the principles of the present invention, the mast assembly being shown as seen from the vehicle side rather than from the prong side.
Figure 2A:
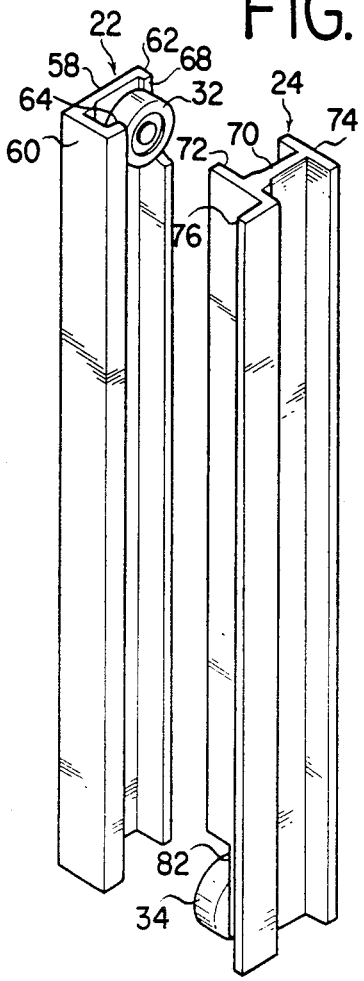
FIGS. 2A and 2B are exploded perspective views of the outer and inner masts, complete with the outer and inner rolls thereon, of the forklift mast assembly of FIG. 1.
Figure 2B:
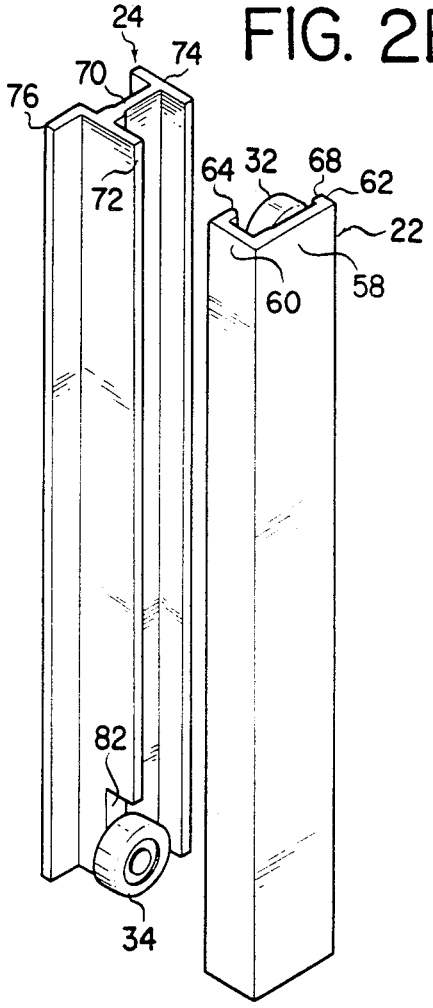

The forklift mast assembly in accordance with the invention will now be described in detail in terms of its first preferred form shown in FIG. 1. Generally designated 20, the representative mast assembly is to be mounted to a suitable self propelled vehicle to make up a forklift or forklift truck. The mast assembly 20 includes a pair of upstanding outer masts 22 horizontally spaced from each other, and a pair of upstanding inner masts 24 also horizontally spaced from each other and disposed just inwardly of the respective outer masts for up and down rolling motion relative to the same. The outer masts 22 are rigidly interconnected only by a tie 26 extending between their bottom ends. The inner masts 24, on the other hand, are rigidly interconnected only by a tie 28 extending between their top ends.

In this specification the terms "inner" and "outer", as well as "inward" and "outward", are intended to refer to the directions toward and away from, respectively, the middle of the mast assembly 20 in its own plane. The terms "front" and "rear", as well as "forward" and "backward", are intended to refer to the directions toward the prong side and toward the vehicle side, respectively, of the mast assembly 20 in planes normal to the plane of the mast assembly. Thus the pair of masts 22 to be mounted to the unshown vehicle are outward of the vertically movable pair of masts 24, and a pair of prong carriers 30 are on the front side of the masts 22 and 24.

As better shown in FIGS. 2A, 2B, 3A, 3B, 4A and 4B the pair of outer masts 22 have each an outer roll 32 rotatably mounted thereto at or adjacent the top end thereof. Each outer roll 32 rotates about a horizontal axis parallel to the plane of the mast assembly 20. The pair of inner masts 24 have each an inner roll 34 rotatably mounted thereto at or adjacent the bottom end thereof. Each inner roll 34 also rotates about a horizontal axis parallel to the plane of the mast assembly 20. The inner masts 24 jointly travel up and down relative to the outer masts 22 via the outer rolls 32 and inner rolls 34.

Figure 5:
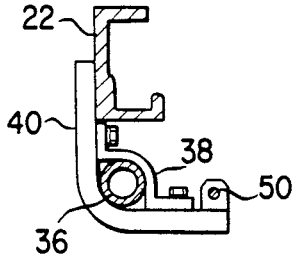
FIG. 5 is a horizontal section taken along the line V—V of FIG. 1 and illustrating the way each fluid actuated cylinder for the up and down motion of the prong carrier means is mounted to one of the outer masts.

With reference back to FIG. 1 a pair of linear actuators such as fluid actuated cylinders 36 are secured to and extend along the respective outer masts 22 on their rear side. As illustrated cross sectionally in FIG. 5, each cylinder 36 is fastened by a clamp 38 to an L shaped bracket 40, which in turn is suitably secured to one of the outer masts 22. Each linear actuator or cylinder 36 has an output member or piston rod 42 extending upwardly therefrom. The top ends of both piston rods 42 are rigidly interconnected by a tie 44. Affixed to the piston rod tie 44 and extending upwardly therefrom are a pair of stops 46 movable with the tie 44, and therefore with the piston rods 42, into and out of abutment against the inner mast tie 28. Further a pair of guide rolls such as sprockets 48 are rotatably mounted on the underside of the piston rod tie 44. Extending over each sprocket 48 is a chain 50 or like elongate flexible member which is anchored at one end to one of the brackets 40 and at the other end to the pair of prong carriers 30. These prong carriers have two or more prongs, not shown, secured thereto so as to extend forwardly therefrom. As shown also in FIG. 6, two pairs of vertically spaced, horizontally offset carrier rolls 52 and 54 are rotatably mounted to the prong carriers 30 via respective brackets 56 for rotation about horizontal axes parallel to the plane of the mast assembly 20. The two pairs of carrier rolls 52 and 54 make rolling engagement with the respective inner masts 24 to allow the rolling motion of the prong carriers 30 along the inner masts.

Thus, as the pair of cylinders 36 are jointly extended from their most contracted state, the prong carriers 30 will roll upwardly relative to the inner masts 24 until the stops 46 come into abutment against the inner mast tie 28. Thereafter the prong carriers 30 and inner masts 24 will both travel upwardly relative to the outer masts 22.

Figure 3A:
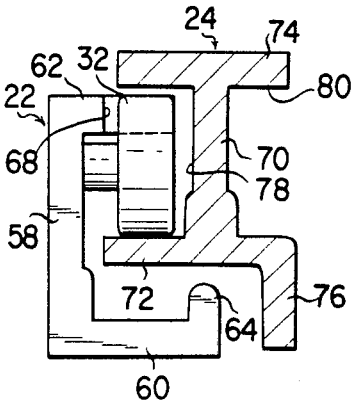
FIGS. 3A and 3B are enlarged horizontal sections taken along the line III—III of FIG. 1 and showing the outer and inner masts, together with the outer rolls on the outer masts, of the forklift mast assembly in their relative working positions.
Figure 3B:
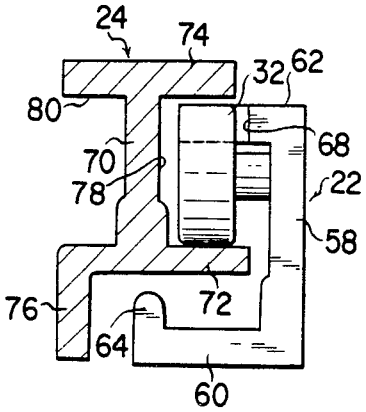
Figure 4A:
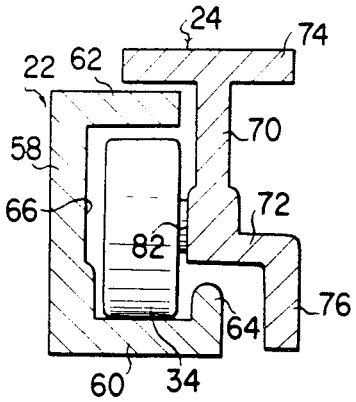
FIGS. 4A and 4B are enlarged horizontal sections taken along the line IV—IV of FIG. 1 and showing the outer and inner masts, together with the inner rolls on the inner masts, of the forklift mast assembly in their relative working positions.
Figure 4B:
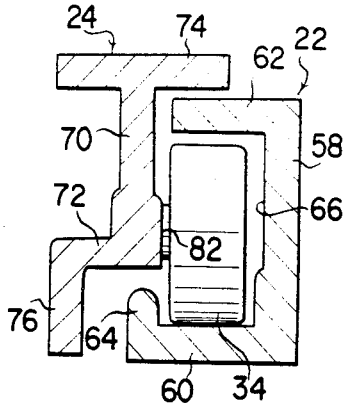

Reference is now directed to FIGS. 2A through 4B and 6 for a more detailed study of the cross sectional shapes of the outer masts 22 and inner masts 24. Each outer mast 22 is of approximately U or C shaped cross section, comprising a web 58 oriented at right angles with the plane of the mast assembly 20, and a pair of flanges 60 and 62 formed on opposite sides of the web in right angular relationship therewith and extending inwardly or toward the other outer mast 22. Further, in accordance with a feature of the invention, the rear flange 60 of each outer mast 22 has a rim 64 bent right angularly and forwardly from its inner edge into parallel spaced relationship with the web 58. Thus, as best seen in FIGS. 4A and 4B, the web 58, rimmed rear flange 60 and front flange 62 of each outer mast 22 define in combination an inwardly open space 66 for rotatably receiving the inner roll 34 on the associated one of the inner masts 24. The inner roll 34 normally makes rolling contact with the outer mast rear flange 60. The outer mast front flange 62 is recessed at 68 to accommodate the outer roll 32 rotatably mounted to the outer mast web 58.

Each inner mast 24 is of substantially H shaped cross section, comprising a web 70 oriented at right angles with the plane of the mast assembly 20, and a pair of flanges 72 and 74 formed on opposite sides of the web 70 in right angular relationship therewith and extending both inwardly and outwardly therefrom. Further a rim 76 extends rearwardly from the inner edge of the inner mast rear flange 72. The rims 76 of both inner masts 24 may be used for connecting the tie 28 therebetween, but the provision of these rims is not essential.

It is thus seen that each inner mast 24 defines an outwardly open space 78, FIGS. 3A and 3B, for rotatably receiving the outer roll 32 on the associated one of the outer masts 22, and an inwardly open space 80 for rotatably receiving one pair of carrier rolls 52 and 54 on the prong carriers 30. The outer roll 32 normally makes rolling contact with the inner mast rear flange 72. Being offset horizontally, the pair of carrier rolls 52 and 54 make rolling contact with the different ones of the inner mast flanges 72 and 74, the upper carrier roll 52 with the front flange 74 and the lower carrier roll 54 with the rear flange 72. The inner mast rear flange 72 is recessed at 82 to accommodate the inner roll 34 rotatably mounted to the inner mast web 70.

OPERATION

The operation of the forklift mast assembly 20 constructed as in the foregoing, particularly of the outer 22 and inner 24 masts in relation to the pront carriers 30, will be best understood from a consideration of FIGS. 7 through 10. The cross sectional shapes of the masts 22 and 24 are well calculated to bear the load imposed on the prong carriers 30 in directions out of the perpendicular in the plane of the mast assembly 20. The masts 22 and 24 function as follows when the prong carriers 30 are loaded somewhat rightwardly and leftwardly as indicated by the arrows designated Fr and Fl in FIG. 1.

Figure 7:
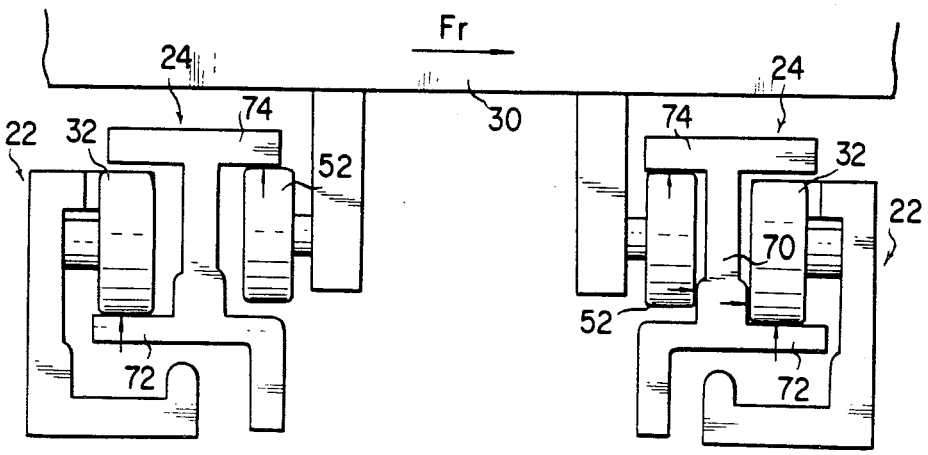
FIGS. 7 and 8 are views explanatory of the way the outer and inner masts of the forklift mast assembly of FIG. 1 bear, in coaction with the outer and inner rolls, the rightward loading of the prong carrier means in the plane of the mast assembly.
Figure 8:
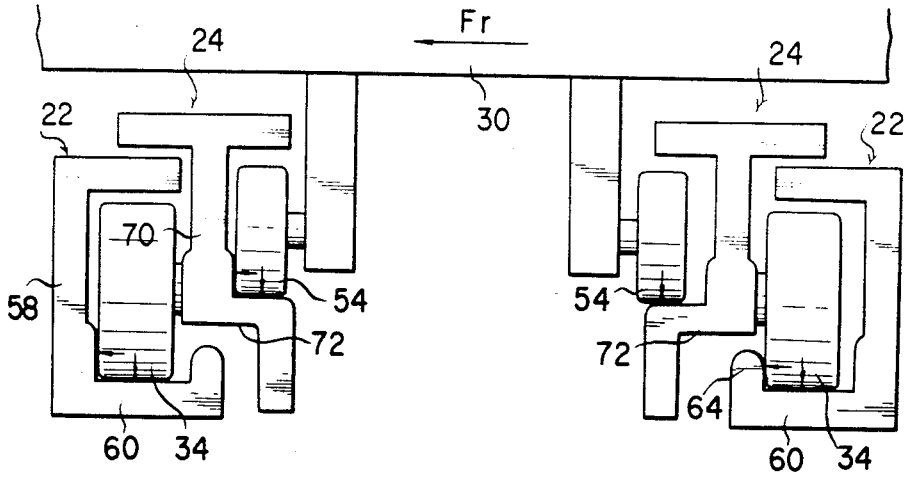

FIGS. 7 and 8 are explanatory of the performance of the masts 22 and 24, in relation to the outer rolls 32, inner roll 34 and carrier rolls 52 and 54, when the prong carriers 30 are loaded rightwardly. As the prong carriers 30 are inclined rightwardly, the upper, right hand carrier roll 52 bears against the web 70 of the right hand inner mast 24, as depicted in FIG. 7, whereas the lower left hand carrier roll 54 bears against the web 70 of the left hand inner mast 24, as seen in FIG. 8. The tie 28, FIG. 1, between the top ends of the inner masts 24 functions to prevent them from spreading apart under the axial thrusts of the carrier rolls 52 and 54.

Loaded by the carrier rolls 52 and 54 as above, the pair of inner masts 24 are also inclined rightwardly. The web 70 of the right hand inner mast 24 bears against the right hand outer roll 32 as in FIG. 7, and the right hand inner roll 34 bears against the rim 64 of the right hand outer mast 22 as in FIG. 8. The left hand inner roll 34, on the other hand, bears against the web 58 of the left hand outer mast 22. Thus the right hand outer mast 22 receives both rightward and leftward forces from the right hand inner mast 24 with its roll 34, thereby cancelling these opposing forces. The left hand outer mast 22 must bear the leftward force of the left hand inner roll 34. The pair of outer masts 22, however, are rigidly interconnected not only by the bottom tie 26 but also by the piston rod tie 44 between the piston rods 42 of the cylinders 36 secured to the respective outer masts. Consequently the outer masts 22 are positively restrained from spreading apart in the face of the leftward force exerted on the left hand outer mast 22 from the left hand inner roll 34.

Figure 9:
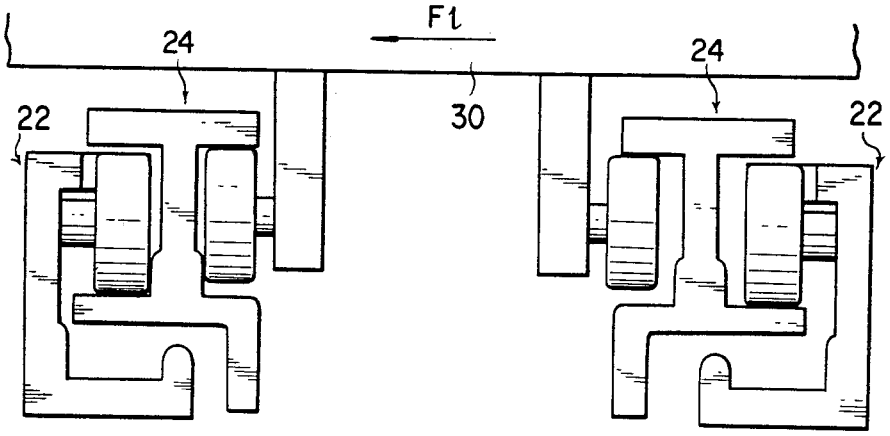
FIGS. 9 and 10 are views similar to FIGS. 7 and 8 but explanatory of the way the outer and inner masts of the forklift mast assembly of FIG. 1 bear the leftward loading of the prong carrier means in coaction with the outer and inner rolls.
Figure 10:
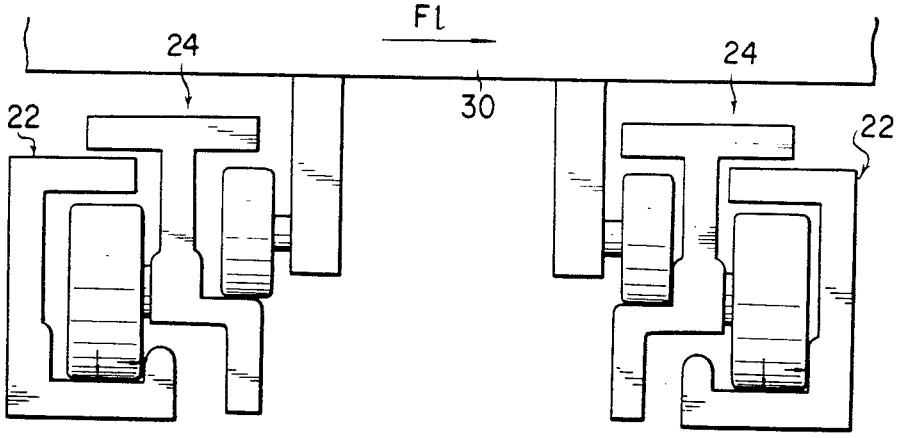

FIGS. 9 and 10 are explanatory of the performance of the masts 22 and 24 when the prong carriers 30 are loaded leftwardly. It will be discerned from the arrows in these drawings that the masts 22 and 24 bear the leftward loading in essentially the same way as they do the rightward loading.

Thus the mast assembly 20 dispenses with the top tie of the outer masts 22 and the bottom tie of the inner masts 24. The operator has therefore an improved vision forward as he operates the forklift for hoisting and moving desired objects. The outer masts 22 are still rigidly interconnected by the bottom tie 26, and the inner masts 24 by the top tie 28. The piston rod tie 44 also functions to prevent the spreading of the outer masts 22. Therefore, when combined via the rolls 32 and 34, the masts 22 and 24 offer sufficient rigidity to bear nonperpendicular loading by the prong carriers 30. Although the masts 22 and 24 do undergo some elastic deformation, experiment has proved that the rolls 32 and 34 easily conform to such deformation and allow the smooth up and down motion of the inner masts 24 relative to the outer masts 22.

It will also be appreciated that the mast assembly 20 is adapted for the so called "free lift" design, such that the prong carriers are lifted to a limited extent while the inner masts 24 are held stationary until the stops 46 on the piston rod tie 44 come into abutment against the inner mast tie 28.

MODIFICATION OF FIRST FORM

Figure 11:
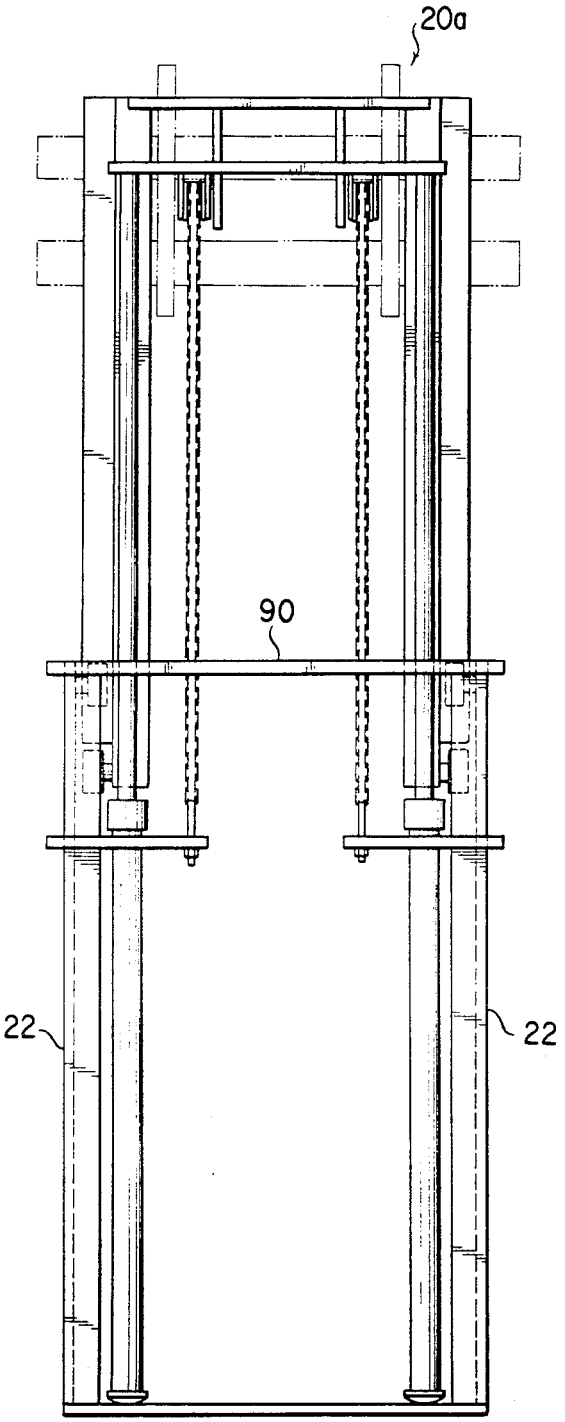
FIG. 11 is a rear elevation of a forklift mast assembly slightly modified from that of FIG. 1 but incorporating the outer and inner masts of the same cross sectional shapes as those of the FIG. 1 mast assembly.

FIG. 11 shows a slight modification of the FIG. 1 embodiment. Generally labelled 20*a*, the modified mast assembly differs from the above mast assembly 20 only in having a tie 90 interconnecting the top ends of the pair of outer masts 22. The outer mast top tie 90 is of course effective to enhance the transverse rigidity of the mast assembly. This additional tie is optional, however, since the mast assembly functions without it, as is apparent from the foregoing description of FIGS. 1 through 10. The other structural and operational details of the mast assembly 20*a* are as set forth above in connection with the mast assembly 20.

SECOND FORM

Figure 12:
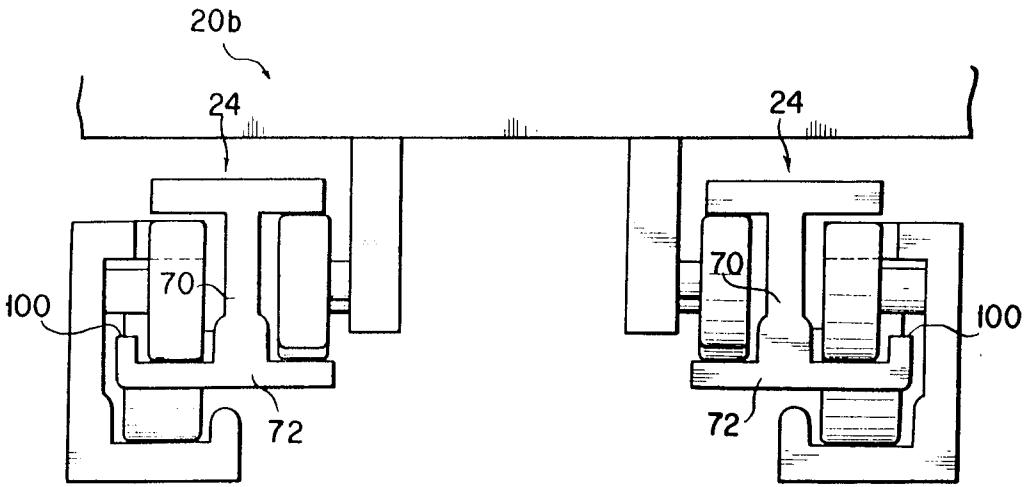
FIG. 12 is a view similar to FIG. 6 but showing a second preferred form of the outer and inner masts for use in a mast assembly of the type shown in FIG. 1.

The second preferred form of the forklift mast assembly in accordance with the invention features the different cross sectional shape of the inner masts 24 illustrated in FIG. 12. The second mast assembly is generally referenced 20*b* in FIG. 12.

Figure 6:
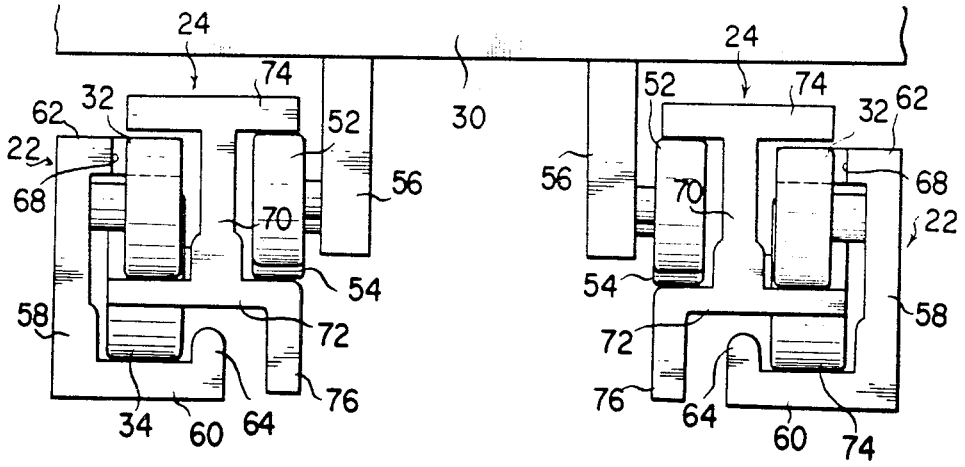
FIG. 6 is an enlarged plan of the outer and inner masts, together with the outer and inner rolls and with carrier rolls on the prong carrier means, of the forklift mast assembly of FIG. 1.

A comparison of FIG. 12 with FIG. 6 in particular will reveal that each inner mast 24 of the mast assembly 20*b* differs from that of the mast assembly 20 in having a rim 100 bent right angularly and forwardly from the outer edge of the inner mast rear flange 72 into parallel spaced relationship with the inner mast web 70. Each inner mast rear flange 72 does not have the rearwardly directed rim 76, FIG. 6, of the mast assembly 20. As has been stated, the rims 76 are unessential because the inner mast tie can be coupled to both inner masts 24 without them. The other details of construction of the mast assembly 20*b* are as set forth above in conjunction with the mast assembly 20.

OPERATION OF SECOND FORM

The operation of the mast assembly 20*b* will become apparent from a consideration of FIGS. 13 through 16. In this second embodiment, as well as in all the additional embodiments to be presented hereafter, the various parts of the mast assembly will be identified by the same reference numerals as used to denote the corresponding parts of the first disclosed mast assembly 20.

Figure 13:
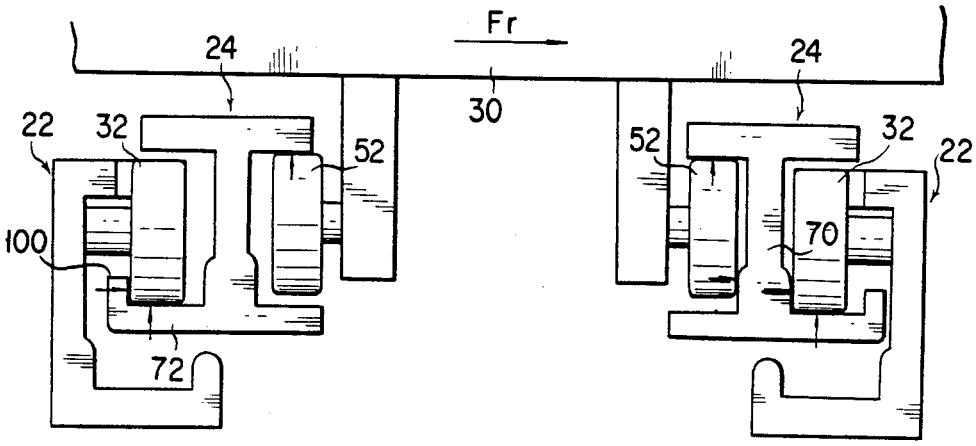
FIGS. 13 and 14 are views explanatory of the way the outer and inner masts of FIG. 12 bear, in coaction with the outer and inner rolls, the rightward loading of the prong carrier means in the plane of the mast assembly.
Figure 14:
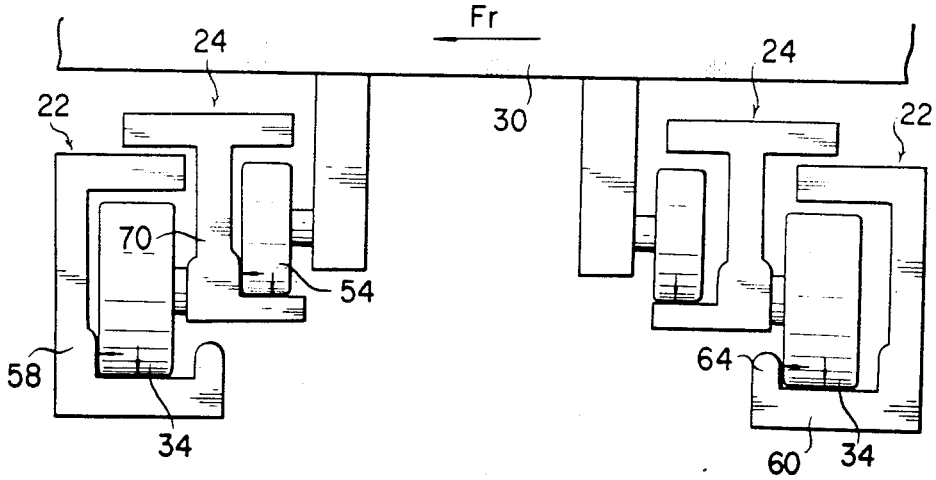

FIGS. 13 and 14 illustrate the way the mast assembly 20*b* bears the load on the prong carriers 30 when the latter are loaded somewhat rightwardly, as indicated by the arrows Fr, in the plane of the mast assembly. As the prong carriers 30 are inclined rightwardly, the upper, right hand carrier roll 52 bears axially against the web 70 of the right hand inner mast 24, as in FIG. 13, and the lower, left hand carrier roll 54 bears axially against the web 70 of the left hand inner mast 24, as in FIG. 14. Thus loaded in the opposite directions, the pair of inner masts 24 bear the axial thrusts of the carrier rolls 52 and 54 as they are rigidly interconnected by the tie 28 as in FIG. 1.

The inner mast pair 24, however, is inclined rightwardly by the axial thrusts of the carrier rolls 52 and 54. Consequently the web 70 of the right hand inner mast 24 bears against the right hand outer roll 32 on the right hand outer mast 22, and the rim 100 of the rear flange 72 of the left hand inner mast 24 bears against the left hand outer roll 32 on the left hand outer mast 22, both as shown in FIG. 13. Further, as will be seen from FIG. 14, the right hand inner roll 34 on the right hand inner mast 24 bears against the rim 64 of the rear flange 60 of the right hand outer mast 22, and the left hand inner roll 34 on the left hand inner mast 24 bears against the web 58 of the left hand outer mast 22.

Figure 15:
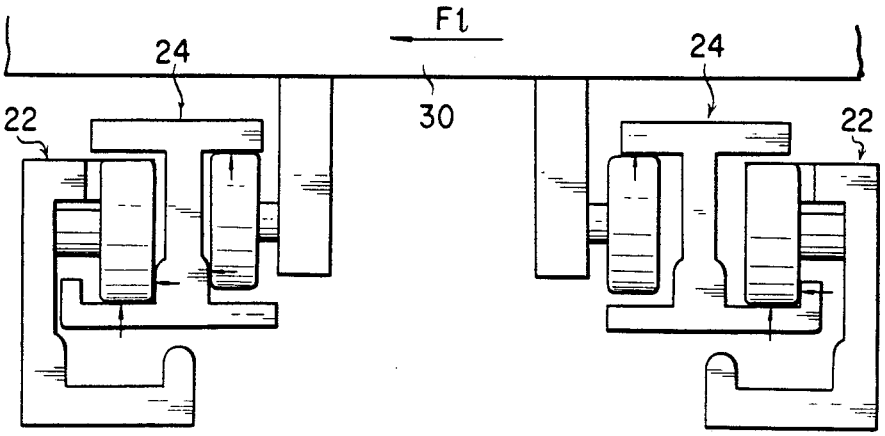
FIGS. 15 and 16 are views similar to FIGS. 13 and 14 but explanatory of the way the outer and inner masts of FIG. 12 bear the leftward loading of the prong carrier means in coaction with the outer and inner rolls.
Figure 16:
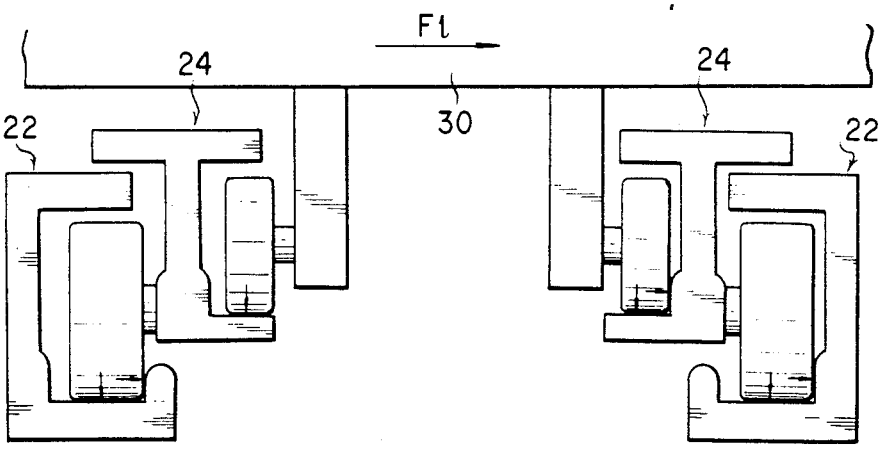

FIGS. 15 and 16 are views similar to FIGS. 13 and 14 except that the masts 22 and 24 are shown loaded leftwardly from the prong carriers 30. The arrows in these figures indicate that the masts 22 and 24 conjointly bear the leftward load Fl the same way as they do the rightward load Fr.

The foregoing will have made clear that each of the pair of inner masts 24 receive both rightward and leftward forces when loaded from the prong carriers 30 either in a rightward or leftward direction. The inner masts can therefore effectively bear the load without a tie between their bottom ends. Each of the pair of outer masts 22 likewise receive both rightward and leftward forces when from the pront carriers 30 via the inner masts 24 either in a rightward or leftward direction. Accordingly the outer masts will not spread apart when so loaded, even though they have no tie between their top ends. The outer masts 22 and inner masts 24 may therefore be tied as in the arrangement of FIG. 1, rather than that of FIG. 11, to offer the advantages set forth already.

THIRD FORM

Figure 17:
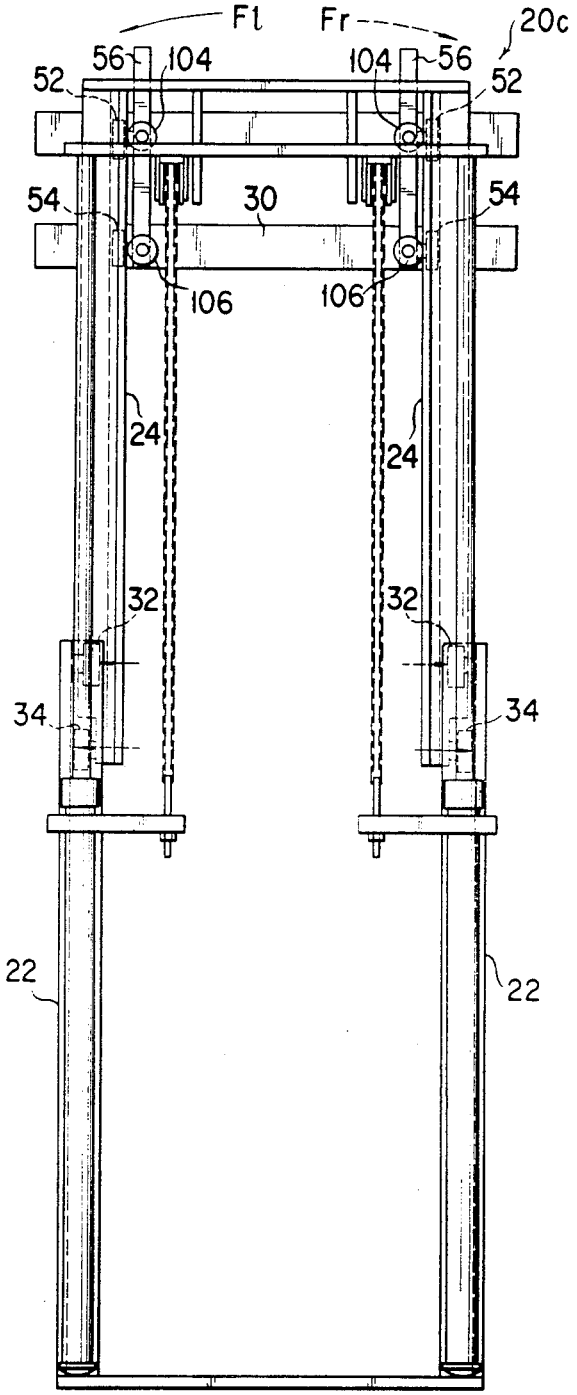
FIG. 17 is a rear elevation of a third preferred form of the forklift mast assembly in accordance with the invention.
Figure 18:
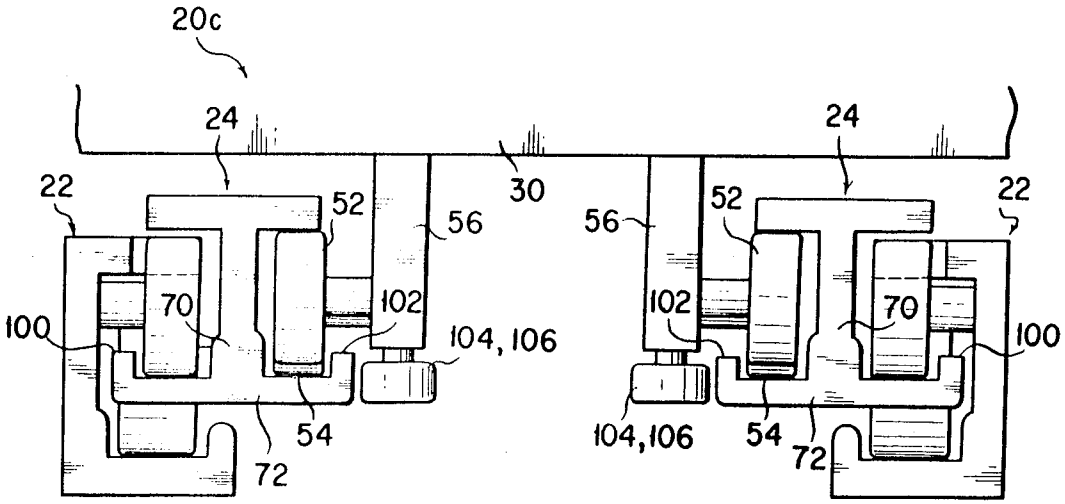
FIG. 18 is an enlarged plan of the outer and inner masts, together with the outer and inner rolls and carrier rolls, of the forklift mast assembly of FIG. 17.

FIGS. 17 and 18 illustrates the third preferred form of the forklift mast assembly in accordance with the invention. This third mast assembly, generally referenced 20*c*, features a different cross sectional shape of each inner mast 24, which in fact is a slight modification of that of the mast assembly 20*b*. As best seen in FIG. 18, each inner mast 24 has a rim 102 bent right angularly and forwardly from the inner edge of the inner mast outer flange 72 into parallel spaced relationship with the inner mast web 70, in addition to the aforesaid rim 100 oriented in the same direction from the outer edge of the inner mast outer flange 72. The rim 100 will hereinafter be referred to as the outer rim, and the rim 102 as the inner rim, by way of contradistinction from each other. Each pair of carrier rolls 52 and 54 on the prong carrier 30 is therefore movable into positive engagement with one inner mast 24 upon axial displacement in both rightward and leftward directions. The other structural details of the inner masts 24 are identical with those of the inner masts of the mast assembly 20*b*. The structural details of the outer masts 22 of this mast assembly 20*c* are identical with those of the outer masts of the mast assemblies 20, 20*a* and 20*b*.

As will be seen from both FIGS. 17 and 18, the mast assembly 20*c* of FIGS. 17 and 18 further features two other pairs of vertically spaced carrier rolls 104 and 106 rotatably mounted to the respective brackets 56 on the prong carriers 30. Each carrier roll 104 or 106 rotates about a horizontal axis normal to the plane of the mast assembly 20*c*. The two pairs of carrier rolls 104 and 106 are disposed just inwardly of the inner masts 24, in such positions that they bear radially against the inner rims 102 of the inner mast outer flanges 72 when the prong carriers 30 are loaded out of the perpendicular in the plane of the mast assembly 20*c*. The other details of construction of the mast assembly 20*c* are as set forth above in connection with the mast assembly 20 in particular.

OPERATION OF THIRD FORM

Figure 19:
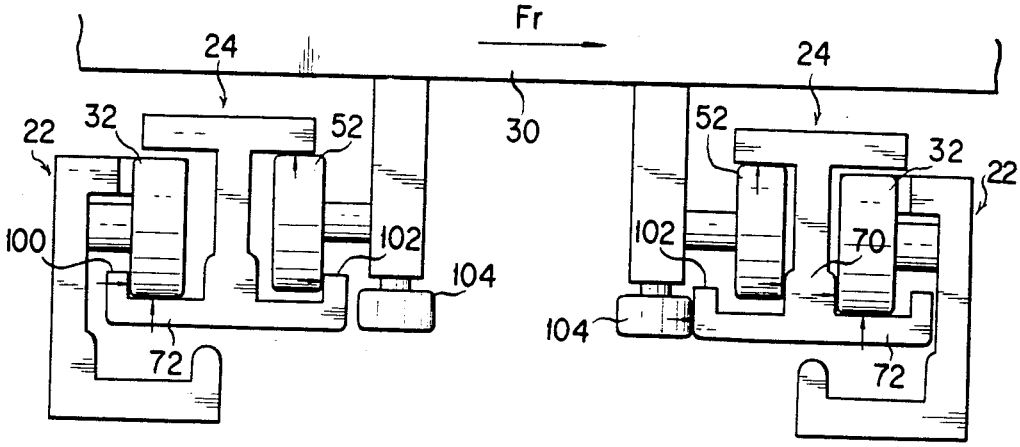
FIGS. 19 and 20 are views explanatory of the way the outer and inner masts of the forklift mast assembly of FIG. 18 bear, in coaction with the outer and inner rolls and carrier rolls, the rightward loading of the prong carrier means in the plane of the mast assembly.
Figure 20:
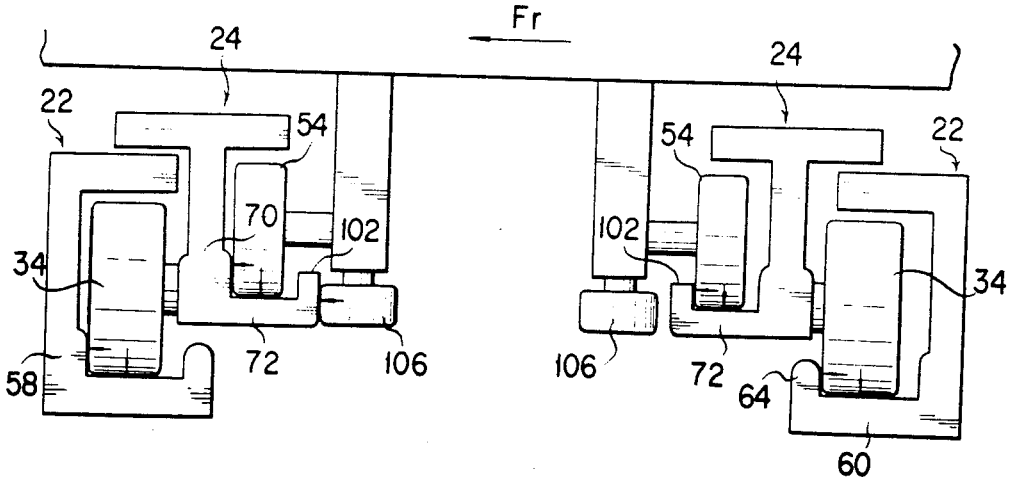

Reference is directed to FIGS. 19 and 20 for the description of the performance of the mast assembly 20*c* when the prong carriers 30 are loaded rightwardly in the plane of the mast assembly, as indicated by the arrows Fr. With reference first to FIG. 19, as the prong carriers 30 incline rightwardly under the load, the upper, right hand carrier roll 104 bears radially against the inner rim 102 of the right hand inner mast rear flange 72. Further the upper, right hand carrier roll 52 bears axially against the right hand inner mast web 70, which web in turn bears against the right hand outer roll 32. As shown also in FIG. 19, the upper, left hand carrier roll 52 bears axially against the inner rim 102 of the left hand inner mast rear flange 72, and the outer rim 100 of the left hand inner mast rear flange 72 bears against the left hand outer roll 32.

Still further, upon rightward slanting of the prong carriers 30 as above, the lower, left hand carrier roll 106 bears radially against the inner rim 102 of the left hand inner mast rear flange 72, as illustrated in FIG. 20. The lower, left hand carrier roll 54 bears axially against the left hand inner mast web 70, and the left hand inner roll 34 bears axially against the left hand outer mast web 58. As shown also in FIG. 20, the lower, right hand carrier roll 54 bears axially against the inner rim 102 of the right hand inner mast rear flange 72, and the right hand inner roll 34 bears axially against the rim 64 of the right hand outer mast rear flange 60.

It will have been seen that each inner mast 24 receives both rightward and leftward forces from the first associated pair of carrier rolls 52 and 54 and second associated pair of carrier rolls 104 and 106. The pair of inner masts 24 can therefore individually bear the rightward loading of the prong carriers 30 without spreading apart from each other. Each outer mast 22 likewise receives both rightward and leftward forces from the associated outer roll 32 and inner roll 34. These opposing forces are therefore cancelled to enable the pair of outer mast 22 to individually bear the rightward loading of the associated inner mast 24 without spreading apart from each other.

Figure 21:
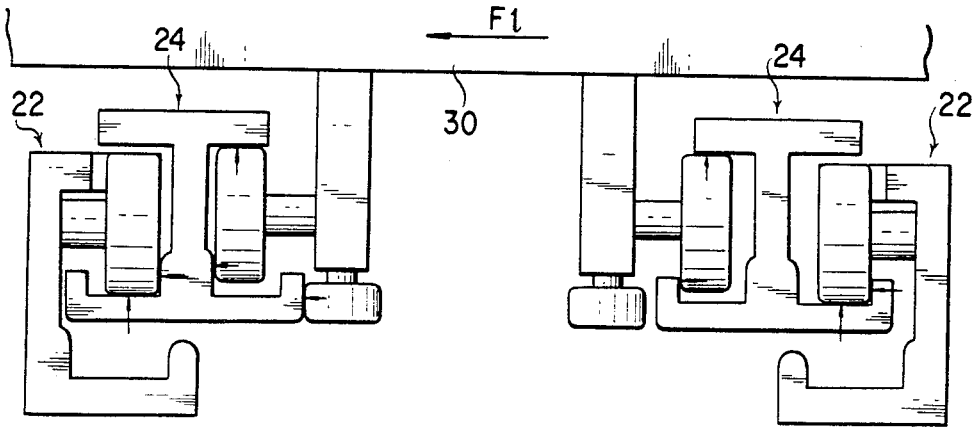
FIGS. 21 and 22 are views similar to FIGS. 19 and 20 but explanatory of the way the outer and inner masts of the forklift mast assembly of FIG. 18 bear the leftward loading of the prong carrier means in coaction with the rolls.
Figure 22:
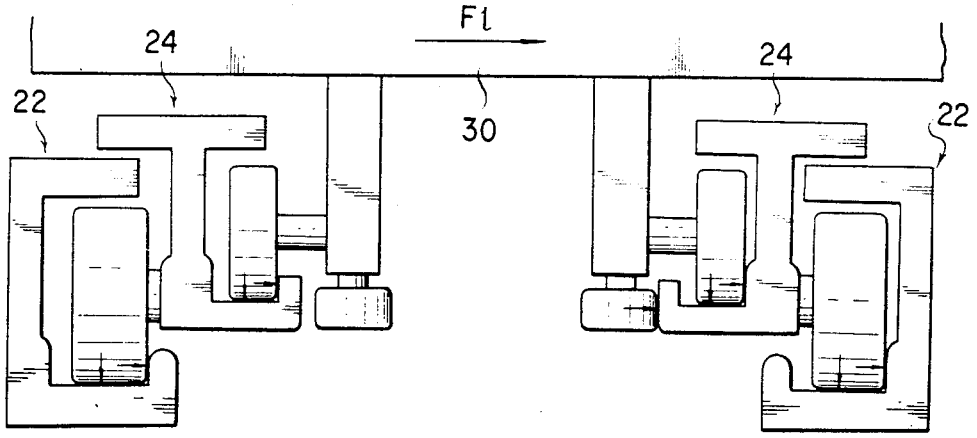

FIGS. 21 and 22 illustrate the performance of the mast assembly 20*c* when the prong carriers 30 are loaded leftwardly as indicated by the arrows Fl. It is apparent from this Figure that the outer masts 22 and inner masts 24 can bear the leftward loading without spreading apart from each other. Accordingly, as will be noted by referring back to FIG. 17, the mast assembly 20*c* also requires no tie between the top ends of the outer masts 22 and between the bottom ends of the inner masts 24.

MODIFICATION OF THIRD FORM

Figure 23:
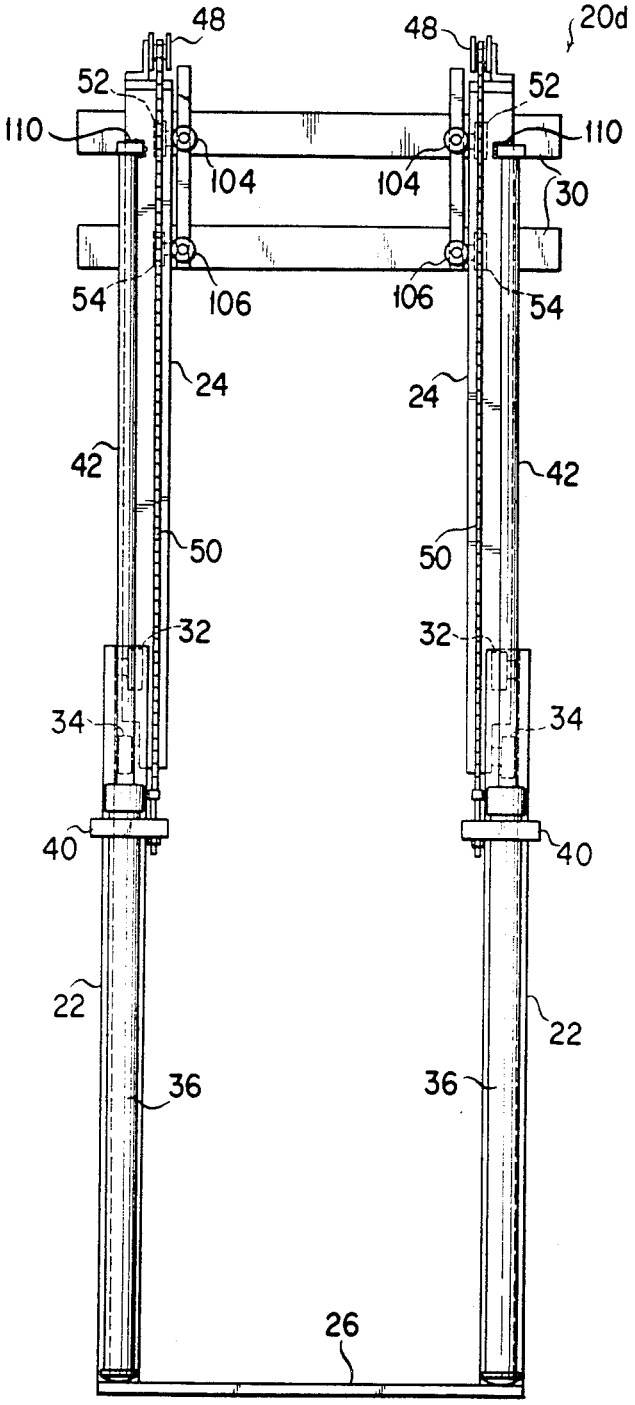
FIG. 23 is a rear elevation of a slight modification of the forklift mast assembly of FIG. 17, the modified mast assembly being different in general organization from that of FIG. 17 but incorporating outer and inner masts of the same cross sectional shapes, and the same carrier roll arrangement, as the mast assembly of FIG. 17.

A further mast assembly 20*d* shown in FIG. 23 can be thought of as a slight modification of the mast assembly 20*c* of FIG. 17 because the cross sectional shapes of the outer and inner masts, and the arrangement of the associated rolls, of this mast assembly 20*d* are identical with those shown in FIG. 18 in conjunction with the mast assembly 20*c*. The mast and roll arrangement of FIG. 18 is so well calculated to bear the nonperpendicular loading of the prong carriers 30 that the mast assembly 20*d* of FIG. 23 dispenses with not only the outer mast top tie and inner mast bottom tie but also the inner mast top tie.

Referring more specifically to FIG. 23, it will be seen that the pair of outer masts 22 are interconnected only by the tie 26 extending between their bottom ends whereas the pair of inner masts 24 have no tie therebetween. The inner mast pair 24 is of course movable up and down along the outer mast pair 22 via the outer 32 and inner 34 rolls. The pair of cylinders 36 are secured to the respective outer masts 22 with the brackets 40 as in the previous embodiments. The piston rods 42 of these cylinders, extending upwardly therefrom, are rigidly coupled at 110 to the respective inner masts 24 for up and down motion therewith. The pair of chains 50 extend between the brackets 40 and the prong carriers 30 via the sprockets 48 mounted atop the inner masts 24, respectively. The prong carriers 30 make rolling engagement with the inner masts 24 via the two pairs of carrier rolls 52 and 54 rotatable about horizontal axes parallel to the plane of the mast assembly 20*d* and the other two pairs of carrier rolls 104 and 106 rotatable about horizontal axes normal to the plane of the mast assembly. Reference may be had to FIG. 18 for a reconfirmation of the way in which the carrier rolls make rolling engagement with the inner masts 24, and of the way in which the inner masts make rolling engagement with the outer masts 22 via the outer 32 and inner 34 rolls.

Thus, with the extension of the cylinders 36, the inner masts 24 travel upwardly of the outer masts 22, causing the prong carriers 30 to ascent in rolling engagement with the inner masts via the chains 50.

A pronounced advantage of this mast assembly 20*d* is, of course, the still more enhanced presentation of the front view to the forklift operator by virtue of the absence of the top tie from between the outer masts 22 and of both top and bottom ties from between the inner masts 24. It is also noteworthy that the inner masts 24 are absolutely free from welding stress as no other parts are welded thereto. The inner masts will therefore more smoothly roll along the outer masts 22 than in cases where a tie or ties are welded thereto. Still further, borne individually by the respective outer masts 22, the inner masts 24 will not affect each other even if they suffer deformation for some reason or other, so that the useful life of the mast assembly will be longer than heretofore.

FOURTH FORM

Figure 24:
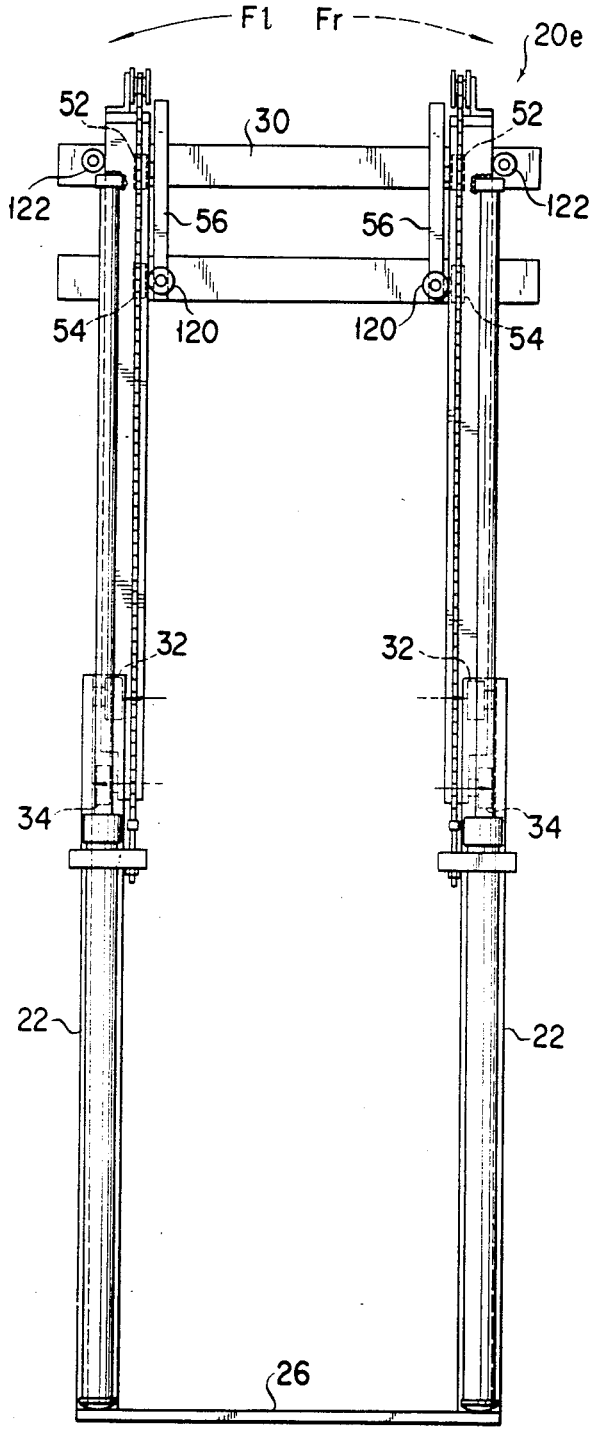
FIG. 24 is a rear elevation of a fourth preferred form of the forklift mast assembly in accordance with the invention, similar in general organization with that of FIG. 23 but incorporating outer and inner masts of different cross sectional shapes, and a different carrier roll arrangement, from those of the mast assemblies of FIGS. 17 and 23.
Figure 25:
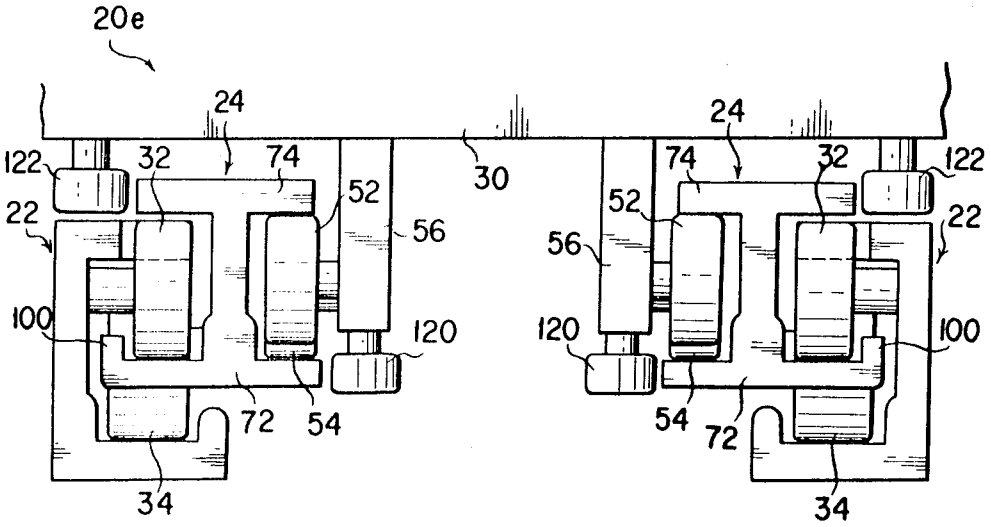
FIG. 25 is an enlarged plan of the outer and inner masts, together with the outer and inner rolls and carrier rolls, of the forklift mast assembly of FIG. 24.

FIGS. 24 and 25 show a still further mast assembly 20*e* embodying the principles of the invention. This mast assembly 20*e* is akin to the mast assembly 20*d* of FIG. 23 in having no top tie between the outer masts 22 and no top and bottom ties between the inner masts 24. However, the mast assembly 20*e* differs from the mast assembly 20*d*, as well as from the mast assembly 20*c* of FIGS. 17 and 18, in the cross sectional shape of the inner masts 24 and in the arrangement of carrier rolls on the prong carriers 30.

An inspection of FIG. 25 will indicate that each inner mast 24 of the mast assembly 20*e* is identical in cross sectional shape with that of the mast assembly 20*b* of FIG. 12, generally H shaped and having the outer rim 100 on the rear flange 72 but no inner rim. The arrangement of the outer 22 and inner 24 masts in relation to the outer 32 and inner 34 rolls is also analogous with that of the mast assembly 20*b*.

The mast assembly 20*e* particularly features the arrangement of carrier rolls on the prong carriers 30 with respect to the outer 22 and inner 24 masts of the above configuration. With reference to both FIGS. 24 and 25 the mast assembly 20*e* has the two pairs of vertically spaced, horizontally offset carrier rolls 52 and 54 rotatably mounted to the respective brackets 56 for rolling engagement with the inner masts 24. There are additionally provided a third pair of horizontally spaced carrier rolls 120 and a fourth pair of horizontally spaced carrier rolls 122. The third pair of carrier rolls 120 are rotatably mounted one to each bracket 56 for rotation about horizontal axes normal to the plane of the mast assembly 20*e*. The carrier rolls 120 are disposed just inwardly of the inner masts 24 for movement into and out of rolling contact with the inner edges of the inner mast rear flanges 72. The fourth pair of carrier rolls 122, on the other hand, are rotatably mounted directly to the prong carriers 30 for rotation about horizontal axes normal to the plane of the the mast assembly 20*e*. The carrier rolls 122 are disposed just outwardly of the inner masts 24 for movement into and out of rolling contact with the outer edges of the inner mast front flanges 74. It will be observed from FIG. 24 that the third 120 and fourth 122 pairs of carrier rolls are vertically spaced from each other, with the third pair 120 positioned a substantial distance below the fourth pair 122.

The other constructional details of the mast assembly 20*e* are as described above in connection with the mast assembly 20*d* of FIG. 23.

OPERATION OF FOURTH FORM

Figure 26:
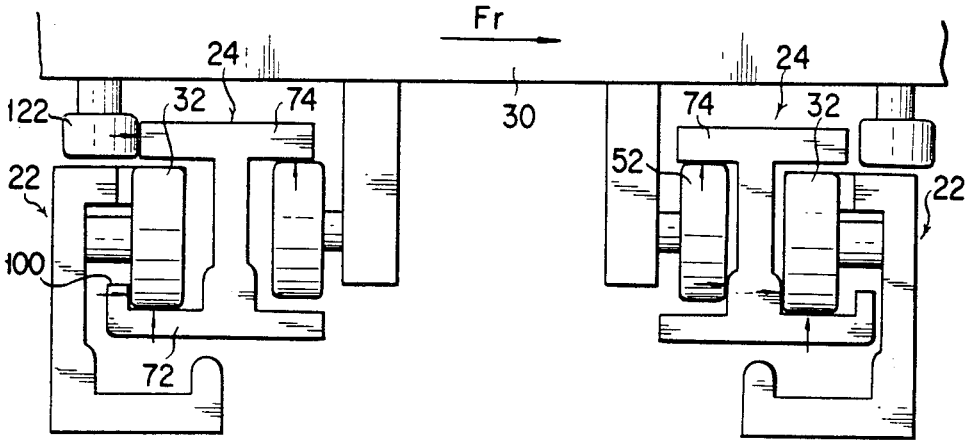
FIGS. 26 and 27 are views explanatory of the way the outer and inner masts of the forklift mast assembly of FIG. 24 bear, in coaction with the outer and inner rolls and carrier rolls, the rightward loading of the prong carrier means in the plane of the mast assembly.
Figure 27:
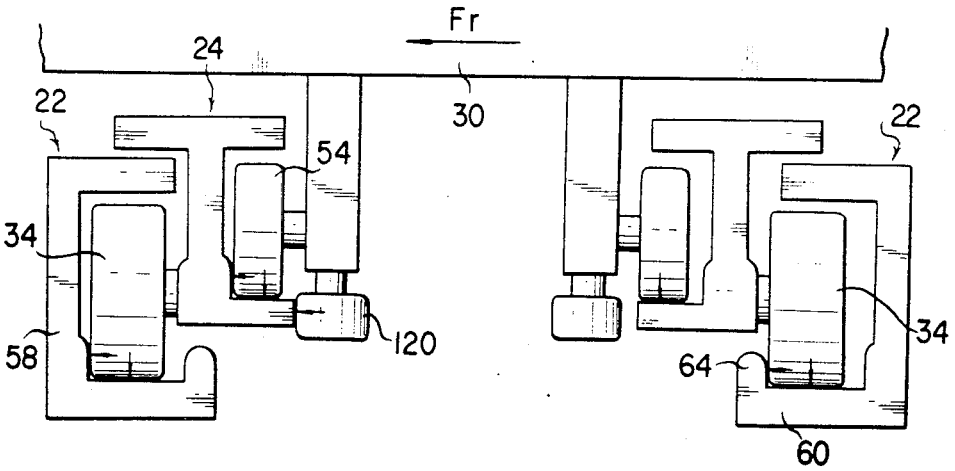

The performance of the mast assembly 20*e* when the prong carriers 30 are loaded somewhat rightwardly, as indicated by the arrow Fr in FIG. 24, will become apparent from a study of FIGS. 26 and 27. With reference to FIG. 26, as the prong carriers 30 incline rightwardly under the load imposed thereon, the left hand carrier roll 122 bears radially against the outer edge of the left hand inner mast front flange 74, and the upper, right hand carrier roll 52 bears axially against the right hand inner mast web 70. This right hand inner mast web 70 bears in turn against the right hand outer roll 32. Further the rim 100 of the left hand inner mast rear flange 72 bears against the left hand outer roll 32.

Moreover, upon rightward inclination of the prong carriers 30, the left hand carrier roll 120 bears radially against the inner edge of the left hand inner mast rear flange 72, as illustrated in FIG. 27. Further the lower, left hand carrier roll 54 bears axially against the left hand inner mast web 70, and the left hand inner roll 34 bears axially against the left hand outer mast web 58. Still further the right hand inner roll 34 bears axially against the rim 64 of the right hand outer mast rear flange 60.

As may have seen from the foregoing, each inner mast 24 receives both rightward and leftward forces, so that the inner masts can individually bear the rightward loading of the prong carriers 30 without spreading apart from each other even though they have no tie therebetween. Each outer mast 22 likewise receives both rightward and leftward forces from the associated outer roll 32 and inner roll 34. These opposing forces are therefore cancelled to enable the pair of outer mast 22 to individually sustain the rightward loading of the associated inner mast 24 without spreading apart from each other even though the outer masts are interconnected only by the bottom tie 26.

Figure 28:
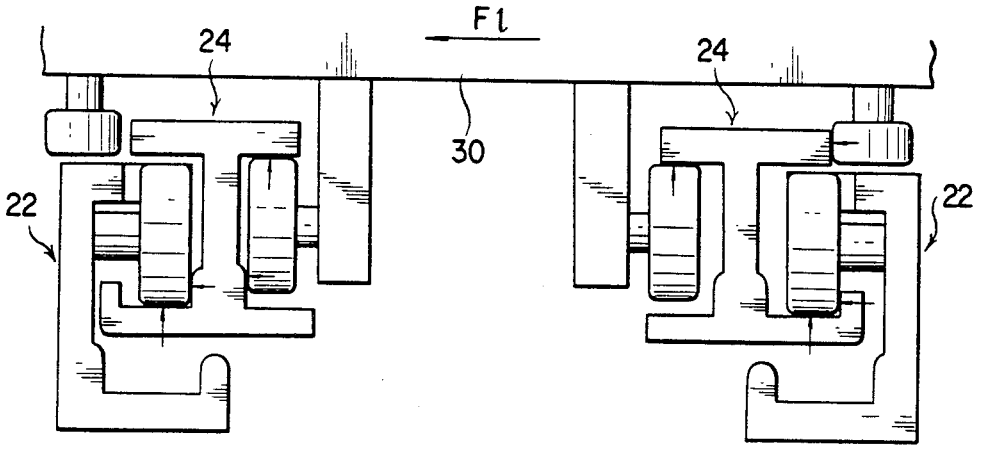
FIGS. 28 and 29 are views similar to FIGS. 26 and 27 but explanatory of the way the outer and inner rolls of the forklift mast assembly of FIG. 24 bear the leftward loading of the prong carrier means in coaction with the rolls.
Figure 29:
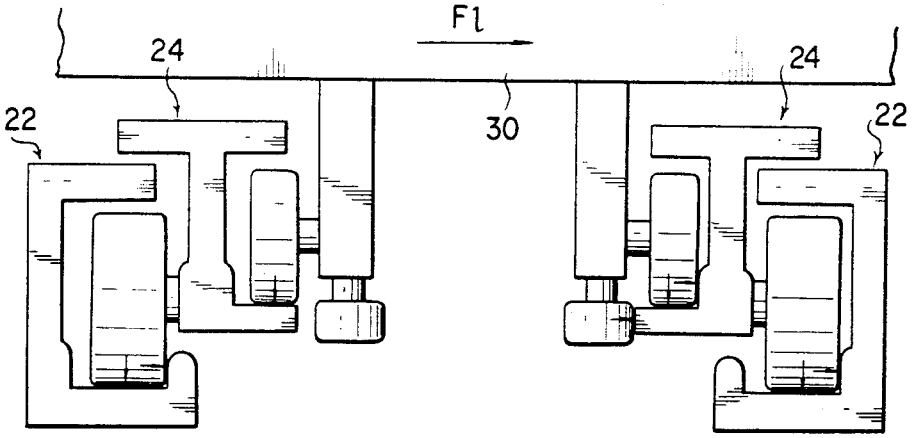

FIGS. 28 and 29 illustrate the performance of the mast assembly 20*c* when the prong carriers 30 are loaded leftwardly as indicated by the arrows Fl. It is self explanatory from this Figure that the outer masts 22 and inner masts 24 can bear the leftward loading of the prong carriers 30 without a top tie between the outer masts 22 and without both top and bottom ties between the inner masts 24. The advantages gained by this mast assembly 20*e* are as previously set forth in connection with the mast assembly 20*d* of FIG. 23.

It will be understood that the several forklift mast assemblies disclosed herein have been selected with the thought of pictorially presenting the principles of the present invention as simply as possible in conjunction with the resulting advantages gained by each mast assembly. It is therefore apparent that various changes may be made in the form, details, arrangements, and proportions of the parts without departing from the scope of the invention.

What is claimed is:

1. In a mast assembly for a forklift, including prong carrier means disposed on one side of the mast assembly, the combination of:

(a) a pair of upstanding outer masts horizontally spaced from each other, each outer mast comprising a first web oriented at right angles with the plane of the mast assembly, first and second flanges formed on opposite sides of the first web in right angular relationship therewith and extending toward the other outer mast, and a rim bent right angularly from the first flange, disposed farther away from the prong carrier means than the second flange, into parallel spaced relationship with the first web;

(b) a pair of outer rolls rotatably mounted one to each outer mast in the adjacency of the top end thereof for rotation about a horizontal axis parallel to the plane of the mast assembly;

(c) a pair of upstanding inner masts horizontally spaced from each other and disposed inwardly of the outer masts for up and down motion relative to the same, each inner mast comprising a second web oriented at right angles with the plane of the mast assembly, and third and fourth flanges formed on opposite sides of the second web in right angular relationship therewith and extending at least in a direction away from the other inner mast, the second web and the third and fourth flanges of each inner mast defining in combination a space in which the outer roll on one of the outer masts is rotatably engaged;

(d) a pair of inner rolls rotatably mounted one to each inner mast in the adjacency of the bottom end thereof for rotation about a horizontal axis parallel to the plane of the mast assembly, the inner roll on each inner mast being rotatably engaged in a space defined by the first web and rimmed first flange and second flange of one of the outer mast, the rims of the first flanges of the outer masts being effective to bear the axial thrust of the inner rolls when the inner masts are loaded out of the perpendicular in the plane of the mast assembly;

(e) two pairs of carrier rolls rotatably mounted on said prong carrier means for rotation about horizontal axes parallel to the plane of said mast assembly, said prong carrier means being movable up and down relative to said outer and inner masts, each pair of carrier rolls being vertically spaced and horizontally offset from each other, said third and fourth flanges of each inner mast further extending toward the other inner mast in right angular relationship with said second web and defining in combination with said second web another space for receiving one pair of carrier rolls, each pair of carrier rolls making rolling contact with the different ones of said third and fourth flanges of the associated inner mast;

(f) first tie means rigidly interconnecting the pair of inner masts only at the top ends thereof;

(g) second tie means rigidly interconnecting the pair of outer masts at least at the bottom ends thereof;

(h) a pair of linear actuators rigidly mounted upstandingly one to each outer mast, each linear actuator having an output member extending upwardly therefrom;

(i) third tie means rigidly interconnecting the top ends of said output members of said linear actuators;

(j) stop means movable with said output members of said linear actuators into and out of abutting engagement with said second tie means;

(k) a pair of guide rolls rotatably mounted to said third tie means; and (l) a pair of elongate flexible members extending between the respective outer masts and said prong carrier means via the respective guide rolls.

2. The forklift mast assembly of claim 1, wherein said third flange of each inner mast, disposed farther away from said prong carrier means than said fourth flange, has a rim bent right angularly from its end directed toward the other inner mast, said rim of said third flange of each inner mast being in parallel spaced relationship with said second web and being effective to bear the axial thrust of one pair of said carrier rolls when said prong carrier means is loaded out of perpendicular in the plane of said mast assembly; and wherein said prong carrier means is further provided with two other pairs of vertically spaced carrier rolls rotatably mounted thereto for rotation about horizontal axes normal to the plane of said mast assembly, said other pairs of carrier rolls being disposed inwardly of said inner masts and bearing radially against said rims of said third flanges of the respective inner masts when said prong carrier means is loaded out of the perpendicular in the plane of said mast assembly.

3. The forklift mast assembly of claim 1, wherein said prong carrier means is further provided with a third pair of horizontally spaced carrier rolls rotatably mounted thereto for rotation about horizontal axes normal to the plane of said mast assembly, said third pair of carrier rolls being disposed inwardly of said inner masts and bearing radially against said third flanges of the respective inner masts when said prong carrier means is loaded out of the perpendicular in the plane of said mast assembly, wherein said prong carrier means is further provided with a fourth pair of horizontally spaced carrier rolls rotatably mounted thereto for rotation about horizontal axes normal to the plane of said mast assembly, said fourth pair of carrier rolls being disposed outwardly of said inner masts and bearing radially against said fourth flanges of the respective inner masts when said prong carrier means is loaded out of the perpendicular in the plane of said mast assembly, wherein said third pair of carrier rolls is spaced vertically from said fourth pair of carrier rolls, and wherein said output member of each said linear actuator is coupled to one inner mast for up and down motion therewith.

* * * * *